US005815929A

United States Patent [19]

Ojea

[11] Patent Number: 5,815,929

[45] Date of Patent: Oct. 6, 1998

[54] CARPET TRIMMING TOOL

[76] Inventor: Antonio M. Ojea, 2000 Longwood Rd., West Palm Beach, Fla. 33409

[21] Appl. No.: 768,594

[22] Filed: Dec. 18, 1996

[51] Int. Cl.[6] ..... B26B 3/08

[52] U.S. Cl. ..... 30/294; 30/289

[58] Field of Search ..... 30/286, 289, 293, 30/294; 83/574, 614, 743, 745

[56] References Cited

U.S. PATENT DOCUMENTS

| | | | |
|---|---|---|---|
| 3,621,573 | 11/1971 | Summers | 30/294 |
| 3,791,014 | 2/1974 | Perna | 30/294 |
| 3,934,341 | 1/1976 | Carlson | 30/287 |
| 4,095,340 | 6/1978 | Kingsley | 30/287 |
| 4,195,406 | 4/1980 | Lackey | 30/294 X |
| 4,646,439 | 3/1987 | Squires | 30/289 |
| 4,667,409 | 5/1987 | D'Amato | 30/289 |
| 5,044,081 | 9/1991 | Nguyen | 30/289 |
| 5,159,758 | 11/1992 | MacDonald | 30/294 |
| 5,485,676 | 1/1996 | Terhorst | 30/294 |

*Primary Examiner*—Hwei-Siu Payer
*Attorney, Agent, or Firm*—Alvin S. Blum

[57] ABSTRACT

A carpet trimming tool precisely trims the edge of a carpet to fit against a carpet divider of the type having a linear channel upstanding from the edge of a thin flat flange fastened to the floor. The tool has a hand grip extending upward from a rigid base. Two elongate, straight parallel spaced apart legs extend downward from the base. A first leg has a foot adapted to slide on the carpet. The second leg has a foot adapted to slide in the channel. A carpet cutting blade is removably and adjustably mounted on the second leg so as to cut through the carpet a preset distance from the channel as tool is advanced, guided by the foot in the channel.

4 Claims, 3 Drawing Sheets

CARPET TRIMMING TOOL

FIELD OF THE INVENTION

This invention relates to devices for guided cutting of sheet material and, more particularly, to a carpet installing tool for precisely trimming the edge of a carpet to fit against a carpet divider of the type having a linear track that accepts a flexible cap for covering the adjoining cut edges.

BACKGROUND OF THE INVENTION

When a carpet is installed against the edge of another floor covering such as tile or wood, the joint therebetween is generally made by a carpet divider. The carpet divider has a thin flat flange that fastens to the floor and a channel upstanding from the flange along one edge thereof. The carpet is cut so that it lies on the flange but does not extend to the channel. A flexible vinyl cap snaps into the channel. The cap has flanges on both sides of the channel that cover over the cut edges of the carpet and the adjoining flooring to provide a finished appearance and protect the cut edges from soil and damage. Because the flange of the cap does not extend very far (less than ⅜ to ¾ inches) from the channel, it is critical that the cut be accurate. If the cut is too short, the edge is exposed. If the cut is too long, the edge will butt up against the channel. Although it may not be immediately evident, it will eventually cause the carpet adjacent the divider to bulge and pucker, requiring a return visit.

The cut to the divider is now done free hand with a carpet knife requiring great skill and care.

SUMMARY OF THE INVENTION

It is, accordingly, an object of the invention to provide a cutting device that will enable a user to quickly, easily, and precisely cut carpet to fit exactly at a carpet divider without requiring special care and skill.

The carpet trimming tool has an uppermost hand grip. Extending downward from the hand grip are elongate, parallel, spaced-apart legs terminating in smooth, flat feet. One foot rests upon the carpet adjacent the divider to stabilize the tool. The other foot slides inside the channel. A replaceable carpet cutting blade is adjustably held in position against the leg supporting the channel riding foot and spaced away from the foot sufficiently to cut the carpet a preset distance from the channel so that the cut edge of the carpet will always lie adjacent the channel for a perfect fit.

These and other objects, advantages and features of the invention will become apparent when the detailed description is studied in conjunction with the drawings in which like reference characters refer to like elements in the various drawing figures.

DETAILED DESCRIPTION OF PREFERRED EMBODIMENT

Figures 1, 2, 5, 7, 8:
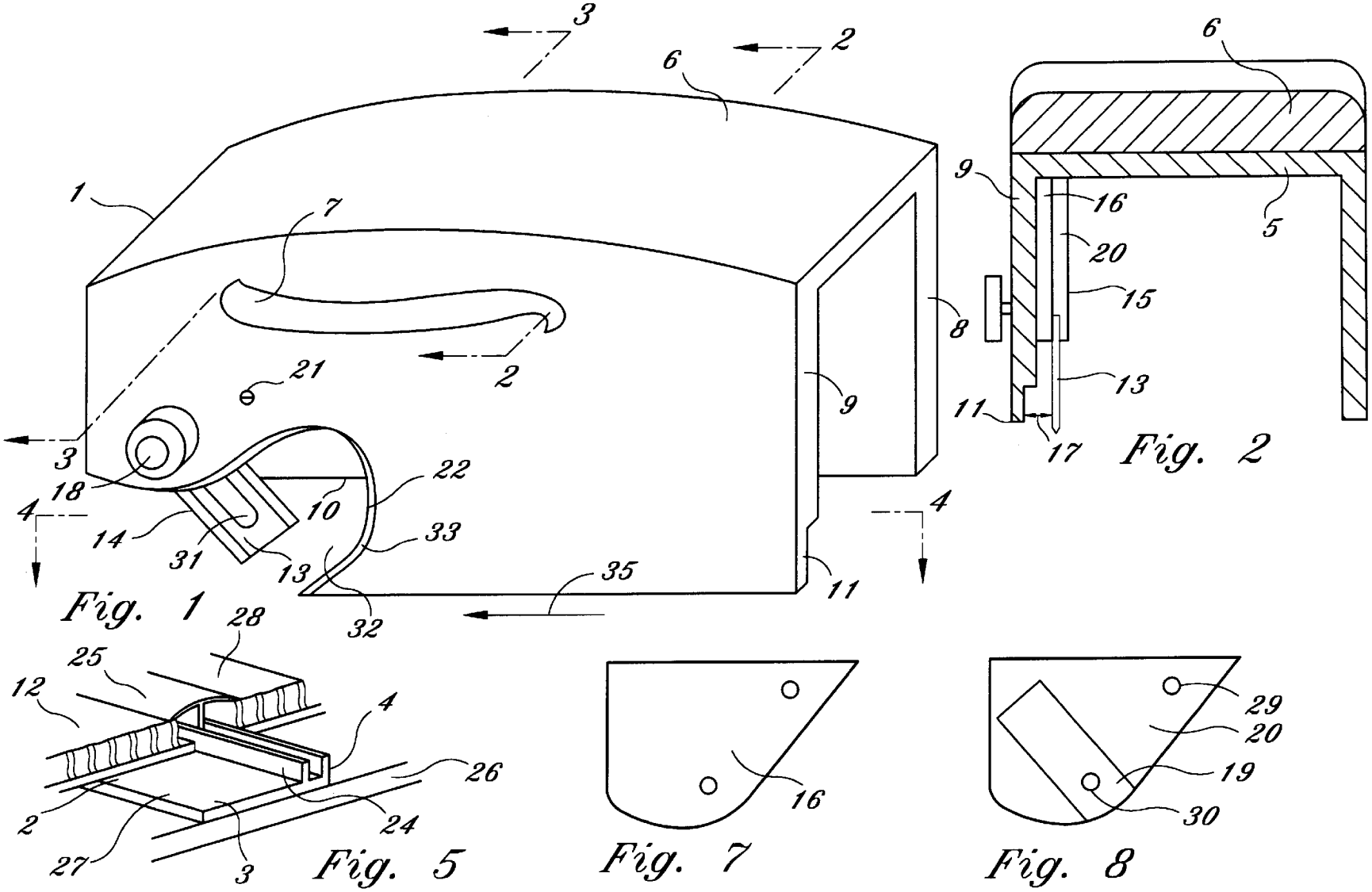
FIG. 1 is a perspective view of the tool.
FIG. 2 is a sectional view taken through line 2—2 of FIG. 1.
FIG. 5 is a perspective view of a carpet divider with properly cut carpet in position.
FIG. 7 is a plan view of the spacer for spacing the blade.
FIG. 8 is a plan view of the blade holding plate.
Figure 3:
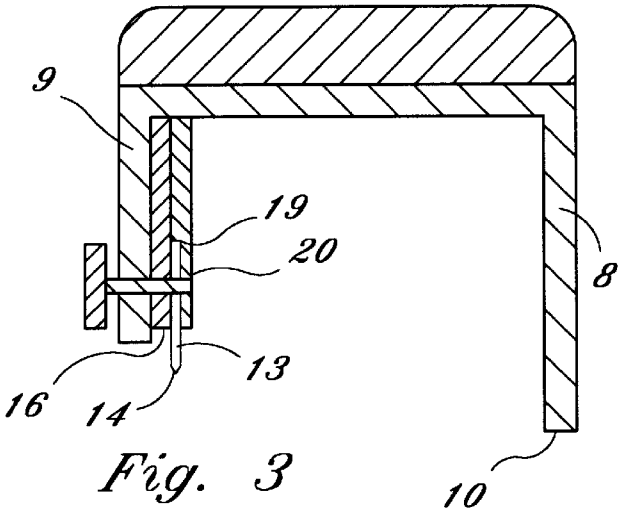
FIG. 3 is a sectional view taken on line 3—3 of FIG. 1.

Referring now first to FIG. 5, a carpet divider 2 is fastened to a floor 26 by screws 27. The divider is an aluminum extrusion with a thin flat flange 3 having an upstanding channel 4 along one edge. The divider is butted up against the edge of other laid flooring such as the different carpet 28 shown or wood or tile flooring. The new carpet 12 must be trimmed so that its cut edge 24 will lie on the flange 3, close enough to the channel 4 to be covered by the resilient vinyl cap 25 that snaps into the channel after the carpet is laid, yet not press against the channel to avoid subsequent problems with bulging and puckering.

Figure 2A:
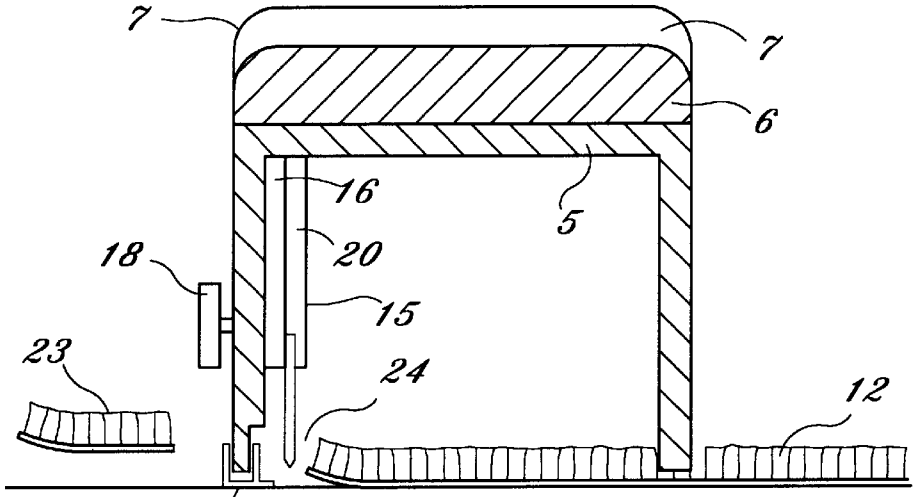
FIG. 2A is a sectional view as in FIG. 2 with carpet.
Figure 3A:
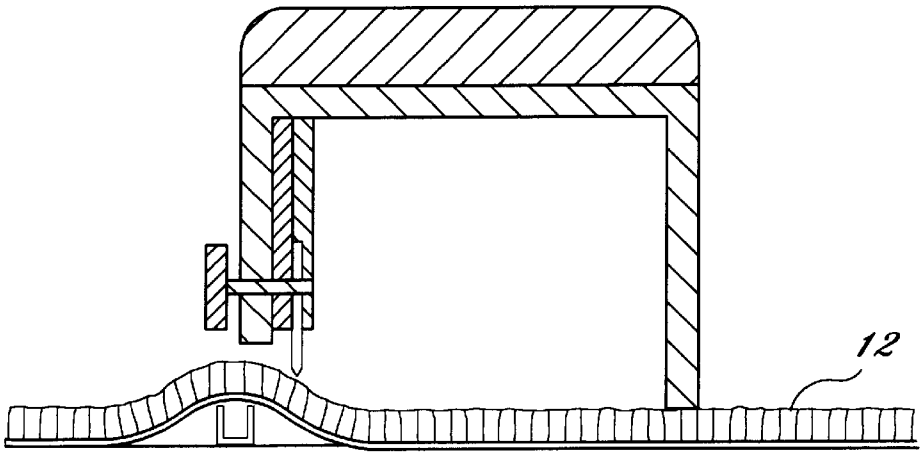
FIG. 3A is a sectional view as in FIG. 3 with carpet.
Figure 4:
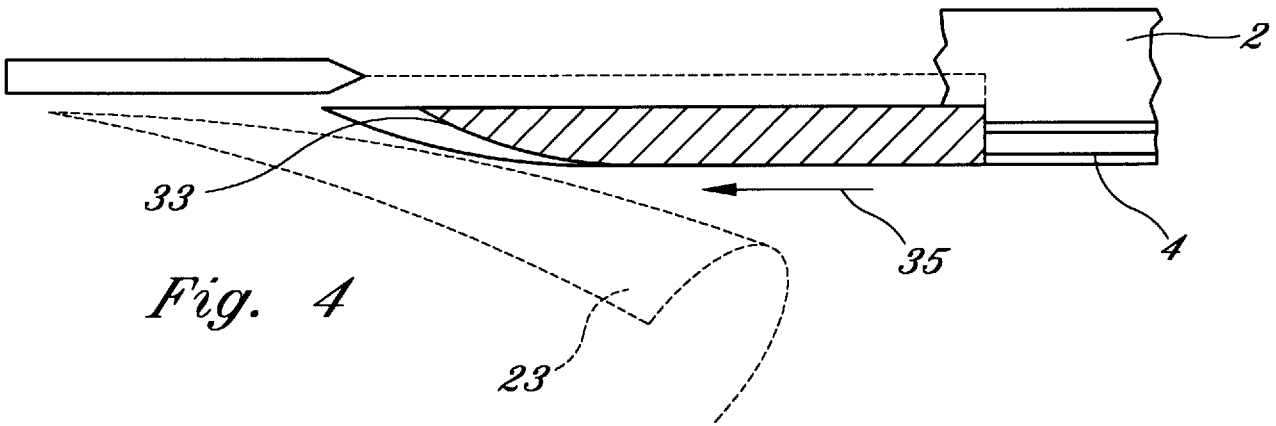
FIG. 4 is a sectional view taken through line 4—4 of FIG. 1.
Figure 6:
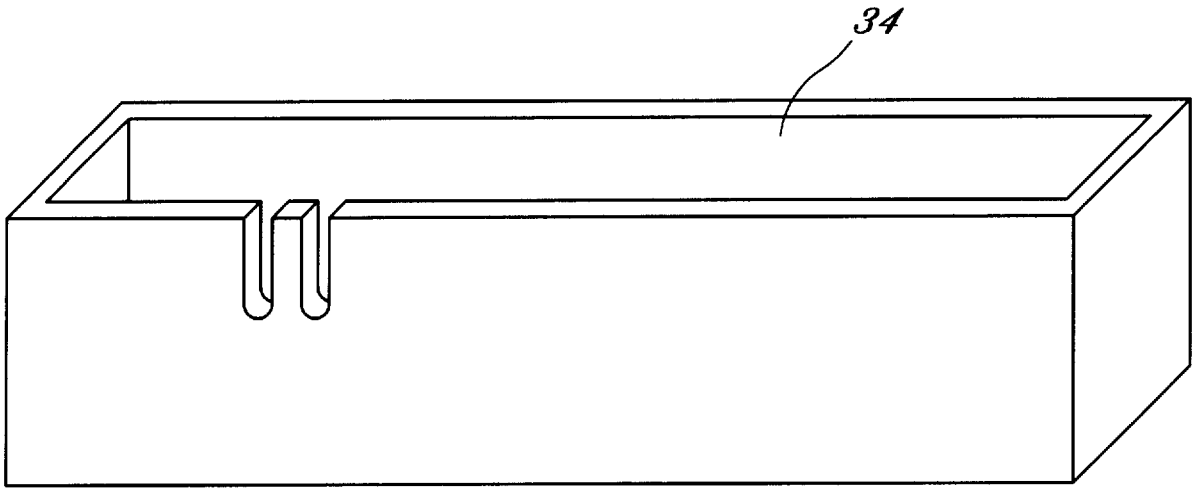
FIG. 6 is a perspective view of a blade protector for the tool.

This trimming action is achieved rapidly and accurately by means of the carpet trimming tool of the invention. Referring now to FIGS. 1–4 and 6–8, the tool 1 comprises a rigid base 5. A molded handgrip 6 attached to the base extends upward therefrom. It may optionally have finger indentations 7 and other well known features to facilitate grasping in one hand. Extending downward from the base are elongate rigid first leg 8 and elongate rigid second leg 9 spaced apart and parallel to one another. The base 5 and legs 8,9 may be molded or extruded in one integral piece as shown. Leg 8 terminates in smooth straight first foot 10 adapted for sliding atop the carpet 12. Leg 9 terminates in smooth, straight second foot 11 which is constructed and dimensioned to fit into and slide along the channel. A conventional replaceable carpet cutting blade 13 has two opposed, interchangable cutting edges 14. Blade holder means 15 connected to the second leg 9 removably and adjustably holds the blade 13 in a fixed position with a cutting edge 14 extending at a slant from the vertical facing downward from the base. It is vertically adjustable to just cut through the carpet as the tool slides along with foot 11 in the channel as best seen in FIG. 2A. The cutting edge 14 is held parallel to foot 11 and spaced apart a preset distance 17 therefrom so as to prepare the finished carpet cut edge 24 to fit properly on the flange 3 of the divider 2. This distance 17 may be three sixteenths of an inch. The blade holder means comprises spacer 16 and blade holding plate 20. The blade holding plate 20 is provided on its inner aspect with a groove 19 to position the blade therein. A flat head screw 21 passes through leg 9 and spacer 16 and engages tapped hole 29 in plate 20 to permanently assemble the blade holder. A removable finger tightening threaded bolt 18 passes through leg 9, spacer 16 and engages tapped hole 30 in plate 20. When a blade is inserted in groove 19, the bolt 18 passes through the slot 31 in the blade as well. When the bolt is finger tightened, the plate 20 is pulled toward spacer 16, tightly gripping the blade between them. This provides a quick and easy means for replacing and adjusting the blade without the need for tools, while maintaining the cutting edge 14 at a preset angle and distance from foot 11. Foot 11 has a length less than that of foot 10. Alternatively, the blade groove may be milled in the spacer 16. Alternatively, spacer 16 may be extruded along with the base and legs in one piece, as desired.

The foot 11 does not extend as far forward as the blade 13 or foot 10. A large aperture 32 in leg 9 enables the blade to extend downward to cut the carpet without interference from leg 9. As the tool 1 is advanced forward in the direction of arrow 35, the blade first engages and cuts the carpet 12. Then the leading edge 22 of leg 9 enters the cut. The leading edge 22 has a sloping face 33 which engages the trimmed carpet portion 23 and forces it upward and away from the divider 2 so that the trimmed portion doesn't interfere with advancing the tool. By having the cutting edge 14 engaging the top surface of the carpet, it is easier to cut carpet being held down by adhesive since the adhesive will not accumulate on the tool. The spaced apart legs ensure that the blade will remain vertical during cutting without special care by the user. The blade may be protected when not in use by slipping blade cover 34 onto leg 9.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention.

What is claimed is:

1. A tool for trimming a carpet for use in conjunction with a carpet divider having a flat flange and a channel upstanding from the flange along one edge thereof, the tool comprising:

a) a rigid base;

b) a hand grip extending upward from the base;

c) first and second elongate, rigid legs parallel to, and spaced apart from, one another extending downward from the base;

d) a smooth flat first foot terminating the first leg for sliding atop the carpet to be trimmed;

e) a smooth flat second foot terminating the second leg, the second foot constructed and dimensioned for fitting into and sliding along the upstanding channel of the carpet divider while the first foot slides atop the carpet, the second foot having a length less than that of the first foot;

f) a carpet cutting blade having at least one long cutting edge;

g) a blade holder means connected to the second leg for removably and adjustably holding the blade with a cutting edge parallel to the second foot at a preset distance therefrom and between the first and second legs and ahead of the second foot such that the carpet will be trimmed to present a cut edge spaced apart a preset distance from the channel when the tool slides along with the first foot atop the carpet and the second foot in the channel.

2. The tool according to claim 1 further comprising a portion of the second leg provided with a sloping leading edge for deflecting the trimmed portion of the carpet away from the channel.

3. The tool according to claim 2, in which the blade holder means holds the cutting edge extending downward from the base.

4. The tool according to claim 1, in which the blade holder means holds the cutting edge extending downward from the base.

* * * * *